US009981169B2

(12) United States Patent
Oldknow et al.

(10) Patent No.: US 9,981,169 B2
(45) **Date of Patent: *May 29, 2018**

(54) GOLF CLUB HEAD OR OTHER BALL STRIKING DEVICE WITH REMOVABLE AND/OR MOVABLE SOLE MEMBER

(71) Applicant: KARSTEN MANUFACTURING CORPORATION, Phoenix, AZ (US)

(72) Inventors: Andrew G. V. Oldknow, Beaverton, OR (US); William F. Rauchholz, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/600,548

(22) Filed: May 19, 2017

(65) Prior Publication Data

US 2017/0259137 A1 Sep. 14, 2017

Related U.S. Application Data

(63) Continuation of application No. 14/715,096, filed on May 18, 2015, now Pat. No. 9,662,550, which is a (Continued)

(51) Int. Cl.

| | |
|---|---|
| ***A63B 69/36*** | (2006.01) |
| ***A63B 53/04*** | (2015.01) |
| ***A63B 53/06*** | (2015.01) |

(52) U.S. Cl.

CPC ..... *A63B 53/06* (2013.01); *A63B 53/0466* (2013.01); *A63B 53/047* (2013.01); (Continued)

(58) Field of Classification Search

CPC ..... A63B 53/06; A63B 2053/0466; A63B 53/0466; A63B 53/047; A63B 2053/0491; A63B 53/0487; A63B 2053/0433 (Continued)

(56) References Cited

U.S. PATENT DOCUMENTS

| | | | |
|---|---|---|---|
| 1,322,182 | A | 11/1919 | Duncan |
| 1,433,744 | A | 10/1922 | Moody et al. |

(Continued)

FOREIGN PATENT DOCUMENTS

| | | | |
|---|---|---|---|
| GB | 2195546 | A | 4/1988 |
| WO | 2010051407 | A1 | 5/2010 |

OTHER PUBLICATIONS

Jan. 27, 2014—(WO) ISR and Written Opinion—App. No. PCT/US2013/043375.

(Continued)

*Primary Examiner* — Sebastiano Passaniti

(57) ABSTRACT

A ball striking device, such as a golf club, includes a head with a face having a striking surface configured for striking a ball and being defined by a plurality of peripheral edges, a body connected to the face and extending rearwardly from the peripheral edges of the face, and a sole member connected to the sole of the body. The sole member may be removably connected to the sole, which can permit removal and replacement with another sole member having a different property. The sole member may additionally or alternately be movably connected to the sole, which can permit adjustment of the sole member, such as to change the lie angle of the head. The sole member may be at least partially received in a receiver in the sole and may form at least a portion of the lowermost surface of the head.

19 Claims, 15 Drawing Sheets

Related U.S. Application Data continuation of application No. 13/485,451, filed on May 31, 2012, now Pat. No. 9,033,813.

(52) U.S. Cl.
CPC ... *A63B 53/0487* (2013.01); *A63B 2053/0433* (2013.01); *A63B 2053/0491* (2013.01)

(58) Field of Classification Search
USPC ..... 473/324–350, 287–292
See application file for complete search history.

(56) References Cited

U.S. PATENT DOCUMENTS

| | | | | |
|---|---|---|---|---|
| 1,607,284 | A | 11/1926 | Kraeuter et al. | |
| D84,525 | S | 6/1931 | Klin | |
| 2,041,676 | A * | 5/1936 | Gallagher | A63B 53/04 473/327 |
| 2,301,369 | A * | 11/1942 | Carvill | A63B 53/04 29/460 |
| 3,556,533 | A | 1/1971 | Hollis | |
| 3,680,868 | A | 8/1972 | Jacob | |
| 4,332,388 | A | 6/1982 | Crow | |
| 5,273,283 | A * | 12/1993 | Bowland | A63B 53/04 473/338 |
| 5,735,754 | A | 4/1998 | Antonious | |
| 5,807,186 | A | 9/1998 | Chen | |
| 5,938,540 | A | 8/1999 | Lu | |
| 5,997,415 | A | 12/1999 | Wood | |
| 6,217,461 | B1 | 4/2001 | Galy | |
| 6,569,029 | B1 | 5/2003 | Hamburger | |
| 7,572,193 | B2 | 8/2009 | Yokota | |
| 7,824,280 | B2 | 11/2010 | Yokota | |
| 7,846,041 | B2 | 12/2010 | Beach et al. | |
| 7,934,999 | B2 | 5/2011 | Cackett et al. | |
| 8,025,587 | B2 | 9/2011 | Beach et al. | |
| 8,235,841 | B2 | 8/2012 | Stites et al. | |
| 8,337,319 | B2 | 12/2012 | Sargent et al. | |
| 8,430,763 | B2 | 4/2013 | Beach et al. | |
| 9,033,813 | B2 | 5/2015 | Oldknow et al. | |
| 9,101,808 | B2 | 8/2015 | Stites et al. | |
| 9,108,090 | B2 | 8/2015 | Stites et al. | |
| 9,662,550 | B2 * | 5/2017 | Oldknow | A63B 53/06 |
| 2006/0122004 | A1 | 6/2006 | Chen et al. | |
| 2009/0221381 | A1 | 9/2009 | Breier et al. | |
| 2013/0090185 | A1 | 4/2013 | Boyd et al. | |
| 2015/0251060 | A1 | 9/2015 | Oldknow et al. | |

OTHER PUBLICATIONS

Dec. 2, 2014—(WO) IPR and Written Opinion—App. No. PCT/US2013/043375.

* cited by examiner

GOLF CLUB HEAD OR OTHER BALL STRIKING DEVICE WITH REMOVABLE AND/OR MOVABLE SOLE MEMBER

CROSS-REFERENCE TO RELATED APPLICATIONS

This application is a continuation of U.S. patent application Ser. No. 14/715,096, filed May 18, 2015, which is a continuation of U.S. patent application Ser. No. 13/485,451, filed May 31, 2012, now U.S. Pat. No. 9,033,813. The above referenced applications are hereby incorporated by reference in their entirety.

TECHNICAL FIELD

The invention relates generally to golf club heads and other ball striking devices that include removable and/or adjustable sole portions. Certain aspects of this invention relate to golf club heads and other ball striking devices that have a sole member that forms at least a portion of the lowermost surface of the head, where the sole member is removable and/or movable to make adjustments to the sole.

BACKGROUND

Golf clubs and many other ball striking devices may have surface angles, contours, and other characteristics that can influence the use and performance of the device. In the case of golf clubs, which are configured to hit a ball that is sitting on or slightly above a playing surface, the interaction between the sole of the club head and the playing surface may significantly affect the swing characteristics of the device. For example, different users may prefer the device to have different lie angles, and changing the lie angle of a typical device may be difficult or impossible. Further options for adjustability and customization for such a device are desirable as well.

The present devices and methods are provided to address at least some of the problems discussed above and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a face having a striking surface configured for striking a ball and being defined by a plurality of peripheral edges, a body connected to the face and extending rearwardly from the peripheral edges of the face, and a removable sole member connected to the sole of the body. The body has a receiver located on the sole, and the sole member is received by the receiver and removably connected to the sole of the body, such that the removable sole member forms at least a portion of a lowermost surface of the head.

According to one aspect, the body further has an elongated channel extending continuously across at least a portion of the sole. The channel is defined by edges located on the body and includes side walls extending inwardly from the edges to a recessed trough, such that the channel is recessed inwardly from the sole. The sole member may include a plug extending into the channel and at least partially filling a portion of the channel, and a cover member extending rearwardly from the plug along the sole of the body. The sole member may have an outer surface that is raised with respect to one or more surfaces of the sole immediately adjacent the receiver. Additionally, the plug of the sole member may engage the side walls and the trough of the channel and completely fill the portion of the channel in one configuration, such that the plug is substantially flush with at least one of the edges of the channel. Further, the receiver and the sole member may have complementary connecting structures removably connecting the sole member to the body. In an additional configuration, at least some portion of the edges of the channel (e.g., a central portion) may extend generally parallel with an adjacent edge of the peripheral edges of the face.

According to another aspect, the sole member completely fills the receiver and has an outer surface that is raised with respect to at least one surface of the sole immediately adjacent the receiver.

According to a further aspect, the sole member is moveable between a first position within the receiver and a second position within the receiver to adjust a lie angle of the device. The outer surface of the sole member is oriented at a first surface angle relative to the striking surface when the sole member is in the first position, and the outer surface of the sole member is oriented at a second surface angle relative to the striking surface when the sole member is in the second position. The sole member may be moveable between the first and second positions by rotating the sole member within the receiver (e.g., a cavity in the sole). Additionally or alternately, the sole member may be moveable between the first and second positions by removing the sole member from the cavity in one of the first and second positions and inserting the sole member into the cavity in another of the first and second positions.

Additional aspects of the invention relate to a golf club head or other ball striking device that includes a face having a striking surface configured for striking a ball and being defined by a plurality of peripheral edges, a body connected to the face and extending rearwardly from the peripheral edges of the face, the body having a sole configured to face a playing surface and a crown opposite the sole, and a removable sole member removably connected to the sole. The removable sole member forms at least a portion of a lowermost surface of the head. A releasable connection mechanism removably connects the sole member to the body.

According to one aspect, the body further has an elongated channel extending continuously across at least a portion of the sole, where the channel is defined by edges located on the body, and the channel is recessed inwardly from the sole. The sole member may also include a plug extending into the channel and completely filling a portion of the channel, such that the plug is substantially flush with at least one surface of the sole immediately adjacent the channel. The sole member may also include a cover member extending rearwardly from the plug along the sole of the body. In such structures, the plug may be used as an attachment device and/or as a means for controlling flexibility of the channel (and the club head's COR response), while the cover member helps control ground contact features of the club head and/or provides variation in weighting, weight distribution, aesthetics, etc.

According to another aspect, the sole member has an outer surface that is angled with respect to surfaces of the sole immediately adjacent the sole member, and the sole member is moveable between a first position and a second position to adjust a lie angle of the device. The outer surface of the sole member is oriented at a first surface angle relative to the ball striking surface when the sole member is in the first position, and the outer surface of the sole member is oriented at a second surface angle relative to the ball striking surface when the sole member is in the second position. The connection mechanism may include a post received in an aperture in at least one of the sole and the sole member to connect the sole member to the body, where the sole member is moveable by rotation about the post.

According to a further aspect, the connection mechanism includes a tab located on one of the sole and the sole member and a slot located on another of the sole and the sole member, where the tab is removably received in the slot to secure the sole member to the body.

According to yet another aspect, the connection mechanism includes a fastener connecting the sole member to the sole, where the fastener is removable to permit the sole member to be removed from the sole.

According to a still further aspect, the connection mechanism includes a post located on one of the sole and the sole member and an aperture located on another of the sole and the sole member. The post has an enlarged, resilient head that is larger than a width of the aperture, and the head of the post is received within the aperture to removably retain the sole member to the body.

Additional aspects of the invention relate to a golf club head or other ball striking device that includes a face having a striking surface configured for striking a ball, the face being defined by a plurality of peripheral edges, a body connected to the face and extending rearwardly from the peripheral edges of the face, the body having a sole configured to face a playing surface and a crown opposite the sole, and a sole member removably connected to the sole of the body. The body may further include a receiver located on the sole, and the sole member may be received by the receiver. The sole member forms at least a portion of a lowermost surface of the head and has an outer surface that is angled with respect to surfaces of the sole immediately adjacent the receiver. The sole member is moveable between a first position within the receiver and a second position within the receiver to adjust a lie angle of the device. The outer surface of the sole member is oriented at a first angle relative to the ball striking surface when the sole member is in the first position, and the outer surface of the sole member is oriented at a second angle relative to the ball striking surface when the sole member is in the second position.

According to one aspect, the body further has an elongated channel extending continuously across at least a portion of the sole. The channel is defined by edges located on the body and comprising side walls extending inwardly from the edges to a recessed trough, such that the channel is recessed inwardly from the sole. The sole member may further include a plug extending into the channel and at least partially filling a portion of the channel and a cover member extending rearwardly from the plug and along the sole of the body.

According to another aspect, the sole member is moveable between the first and second positions by rotating at least a portion of the sole member within the receiver.

According to a further aspect, the sole member is moveable between the first and second positions by removing the sole member from the receiver in one of the first and second positions and inserting the sole member into the receiver in another of the first and second positions.

Further aspects of the invention relate to a kit or assembly that includes a head for a ball striking device having a face with a striking surface configured for striking a ball, the face being defined by a plurality of peripheral edges, and a body connected to the face and extending rearwardly from the peripheral edges of the face, the body having a sole configured to face a playing surface and a crown opposite the sole. The assembly also includes a first removable sole member configured for removable connection to the sole of the body, such that the first removable sole member forms at least a portion of a lowermost surface of the head when connected to the body, and a second removable sole member configured for removable connection to the sole of the body, such that the second removable sole member forms at least a portion of the lowermost surface of the head when connected to the body. The second removable sole member has at least one property that is different from the first removable sole member. The first and second sole members may be shaped and sized so as to fit within and/or be separately and individually attachable to the same receiver or cavity on the club head.

According to one aspect, the second removable sole member has an outer surface configured to form the at least a portion of the lowermost surface of the head when connected to the body, with the outermost surface of the second removable sole member having a different surface contour and/or other shape/configuration than an outermost surface of the first removable sole member.

According to another aspect, the second removable sole member has an outer surface configured to form the at least a portion of the lowermost surface of the head when connected to the body, with the outermost surface of the second removable sole member having a different surface angle than an outermost surface of the first removable sole member.

According to further aspects, the second removable sole member has a weight and/or a weight distribution that is different than the first removable sole member. As some additional examples or alternatives, if desired, the different sole members for attachment to a single club head body may have different shapes or features to alter the lie and/or loft angle of the club heads. As some more specific examples, by attaching keels of different shapes, the club head's effective lie and loft angles could be altered (e.g., by placing a thicker front keel portion with a steeper keel curve, the loft angle may be increased somewhat (or vice versa), by making one side thicker than the other (heel side thicker than toe side or vice versa), the lie angle could be changed, etc.). These features could be used in conjunction with or as a replacement for an interchangeable club head/shaft connection system. As another example, if desired, the hosel location may be adjustable to enable the shaft position to remain constant when other angles of the club head are altered.

According to yet another aspect, the body further has an elongated channel extending continuously across at least a portion of the sole, the channel being defined by edges located on the body, wherein the channel is recessed inwardly from the sole. The first removable sole member may include a first plug configured to extend into the channel and fill at least a portion of the channel and a first cover member extending rearwardly from the first plug and configured to extend along the sole of the body, such that the first plug is substantially flush with at least one surface of the sole immediately adjacent the channel. The second removable sole member may include a second plug configured to extend into the channel and fill at least a portion of the channel and a second cover member extending rearwardly from the second plug and configured to extend along the sole of the body, such that the second plug is substantially flush with at least one surface of the sole immediately adjacent the channel. The second plug may have at least one property that is different from the first plug. For example, the second plug may be configured to fill a different portion of the channel than the first plug, and/or the second plug may have a flexibility and/or compressibility that is different than a flexibility/compressibility of the first plug. In this manner, plug selection can be used to control/customize the flexion characteristics of the channel and/or the COR response of the club head.

According to a still further aspect, the first removable sole member and the second removable sole member each have connecting structures configured for removable connection to the body, where the connecting structures of the first and second removable sole members are the same type and can engage the same connecting structure on the club head.

Still further aspects of the invention relate to methods in which a golf club head as described above is provided, including a face and a body connected to the face, and a removable and/or moveable sole member connected to the body, as described above. In the case of a removable sole member, the method may also include removing the sole member and replacing it with a second sole member. In the case of a moveable and/or adjustable sole member, the method may further include moving the sole member to a different desired position. The method may further include connecting a shaft to the head.

Other aspects of the invention relate to golf clubs that include a head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
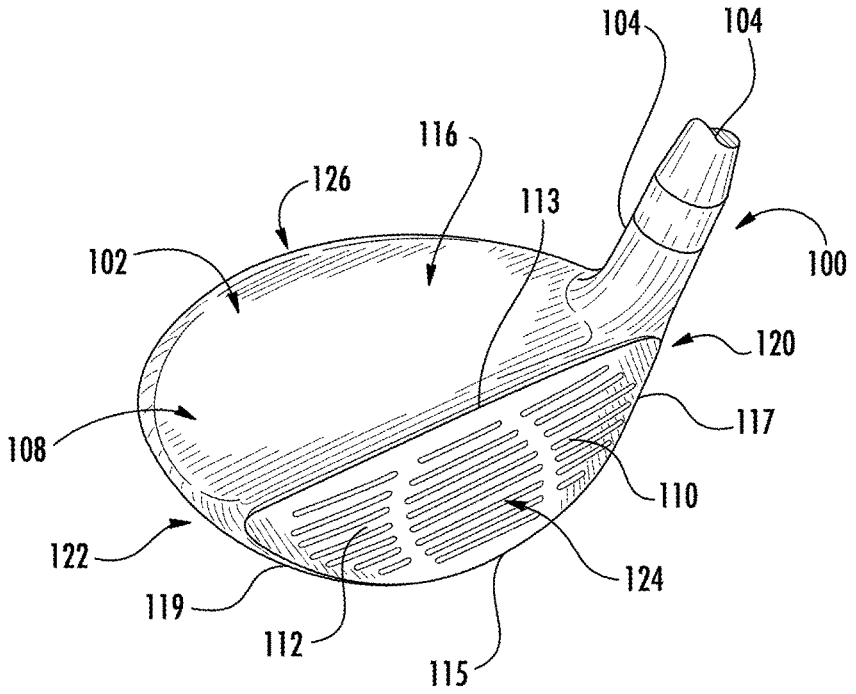
FIG. 1 is a top perspective view of an illustrative embodiment of a head of a ball striking device according to the present invention, in the form of a wood-type golf club head.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Transverse" means extending across or in a cross direction to a line, plane, edge, surface, etc., defined at an actual or virtual intersection point, but does not necessarily imply a perpendicular intersection.

"Flush" means that a surface of one article is level and aligned with or smoothly curved with respect to an adjacent surface such that there is no abrupt step or change in level between the surface edge at the one side of the junction and the surface edge at the other side of the junction. An "abrupt step" or "change in level" between two adjacent surfaces means a step or level change between the two surfaces of at least 0.1 inches if one were to continue and project the surface at one side of the junction across the junction to the surface at the other side of the function. The term "substantially flush" as used herein means that the adjacent surfaces are level and aligned or smoothly curved with respect to one another without an abrupt step or change in level of more than 0.2 inches between the surface edge at one side of the junction and the surface edge at the other side of the junction. A gap may be provided between two "flush" or "substantially flush" surfaces at the junction provided that the surface edges at the junction remain level and aligned or smoothly curved with respect to one another.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well. Ball striking surfaces may have some curvature, e.g., bulge and roll in golf club faces.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys). It is understood that the head may contain components made of several different materials, including carbon-fiber composites, polymer materials, and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIGS. 1 and 1A, which illustrate one illustrative embodiment of a ball striking device 100 in the form of a wood-type golf club (e.g. a driver), although it is understood that similar configurations may be used for other wood-type clubs, including a fairway wood (e.g., a 3-wood, 5-wood, 7-wood, etc.) or a hybrid club.

Figure 1A:
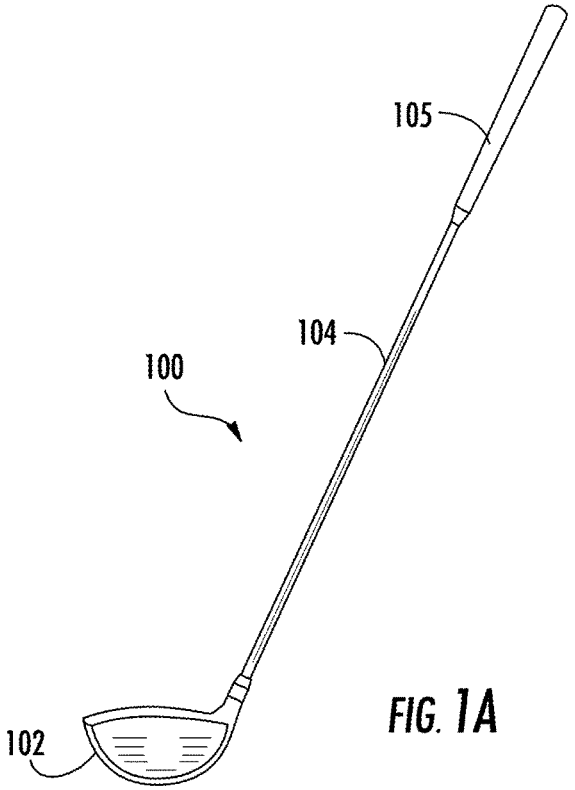
FIG. 1A is a plan view of a golf club including a head according to aspects of the present invention.

The golf club 100 shown in FIG. 1A includes a ball striking head 102 configured to strike a ball in use and a shaft 104 connected to the ball striking head 102 and extending therefrom. FIGS. 1-5 illustrate one embodiment of a ball striking head 102 in the form of a golf club head 102 that has a face 112 connected to a body 108, with a hosel 109 extending therefrom and a shaft 104 connected to the hosel 109. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top or crown 116, a bottom or sole 118, a heel 120 proximate the hosel 109, a toe 122 distal from the hosel 109, a front 124, and a back or rear 126, as shown in FIGS. 1-5. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-5, the head 102 has an enclosed volume, as the club 100 is a wood-type club designed for use as a driver, intended to hit the ball long distances. In other applications, such as for a different type of golf club, the head 102 may be designed to have different dimensions and configurations. For example, when configured as a driver, the club head 102 may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art. The club head 102 loft angle also may vary, e.g., depending on the shot distance desired for the club head 102.

The body 108 of the head 102 can have various different shapes, including a rounded shape, as in the head 102 shown in FIGS. 1-5, a squared or rectangular shape, or any other of a variety of other shapes. It is understood that such shapes may be configured to distribute weight in any desired, manner, e.g., away from the face 112 and/or the geometric/volumetric center of the head 102, in order to create a lower center of gravity and/or a higher moment of inertia.

In the illustrative embodiment illustrated in FIGS. 1-5, the head 102 has a hollow structure defining an inner cavity 101 (FIG. 5) (e.g., defined by the face 112 and the body 108) with a plurality of inner surfaces defined therein. In one embodiment, the inner cavity 101 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 101 may not be completely enclosed in some embodiments.

Figure 4:
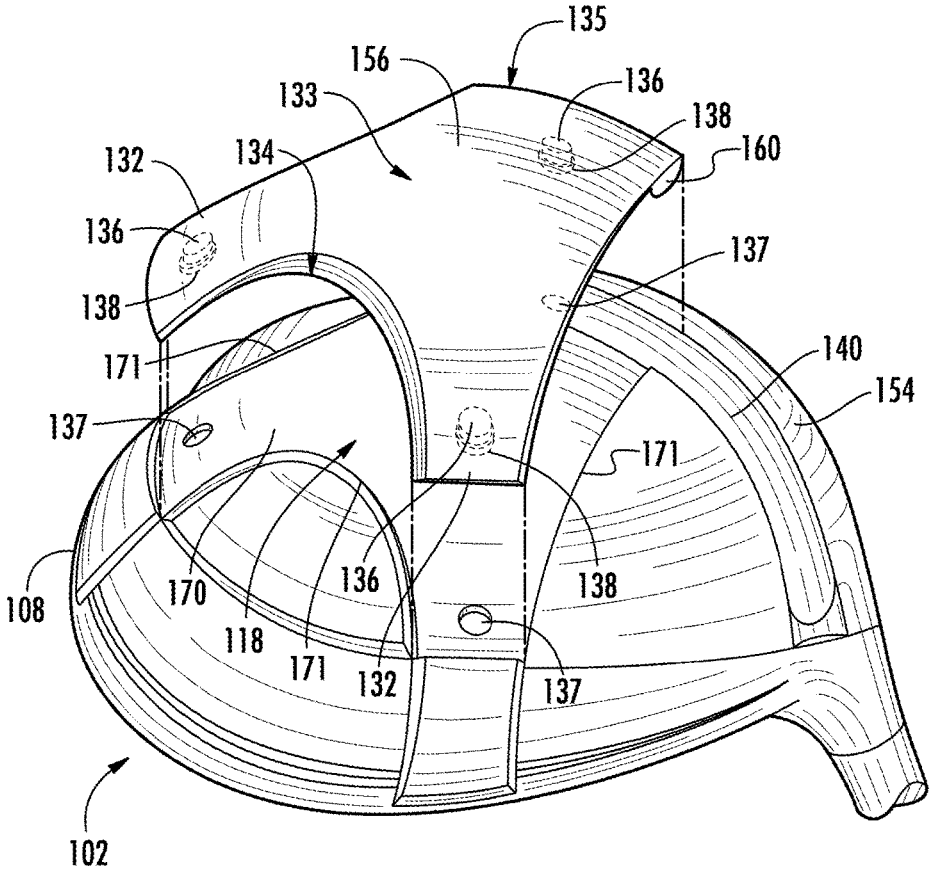
FIG. 4 is a bottom perspective view of the head of FIG. 1, showing the connection of a removable sole member to the head.
Figure 5:
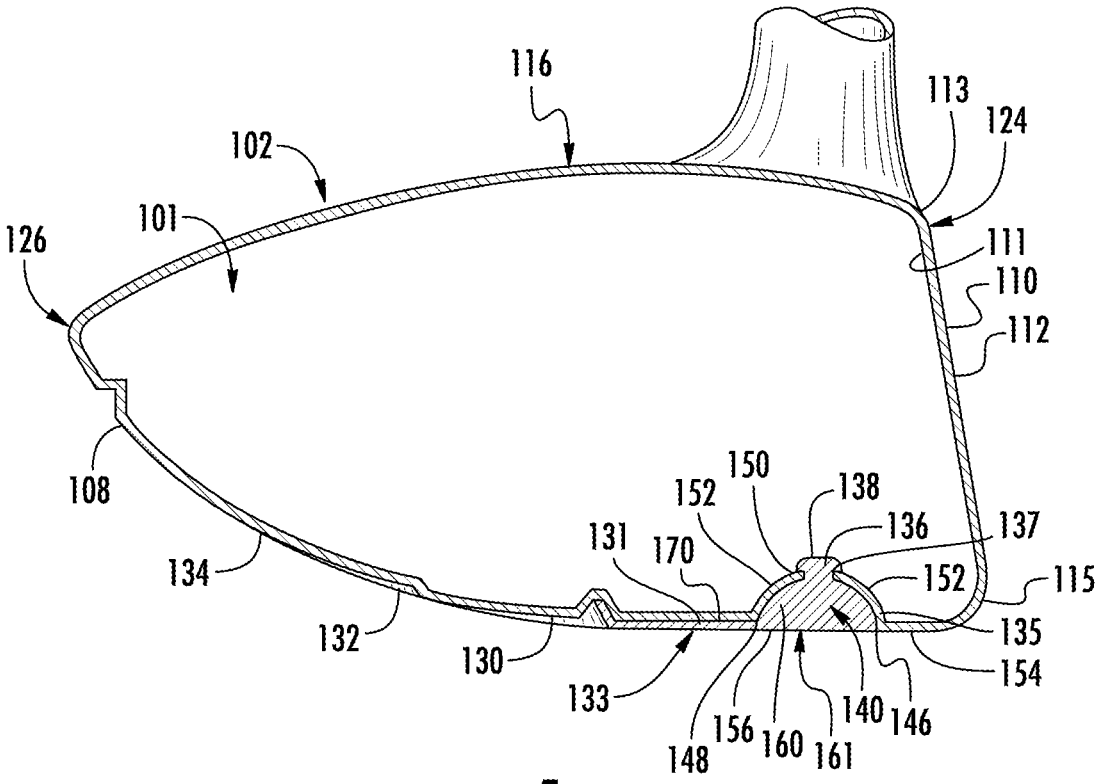
FIG. 5 is a cross-section view of the head of FIG. 1, taken along lines 5-5 of FIG. 2.

The face 112 is located at the front 124 of the head 102 and has a ball striking surface (or striking surface) 110 located thereon and an inner surface 111 opposite the ball striking surface 110, as illustrated in FIG. 5. The ball striking surface 110 is typically an outer surface of the face 112 configured to face a ball in use and is adapted to strike the ball when the golf club 100 is set in motion, such as by swinging. As shown, the ball striking surface 110 is relatively flat, occupying at least a majority of the face 112. The face 112 has a plurality of outer or peripheral edges, including a top edge 113, a bottom edge 115, and lateral edges (including heel edge 117 and toe edge 119). The edges of the face 112 may be defined as the boundaries of an area of the face 112 that is specifically designed to contact the ball in use, and may be recognized as the boundaries of an area of the face 112 that is intentionally shaped and configured to be suited for ball contact. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-5, the ball striking surface 110 is inclined with respect to the ground or contact surface (i.e., at a loft angle), to give the ball a desired lift and spin when struck. In other illustrative embodiments, the ball striking surface 110 may have a different incline or loft angle, to affect the trajectory of the ball. Additionally, the face 112 may have a variable thickness and also may have one or more internal or external inserts and/or supports in some embodiments.

It is understood that the face 112, the body 108, and/or the hosel 109 can be formed as a single piece or as separate pieces that are joined together. The face 112 may be formed as a face plate member with the body 108 being partially or wholly formed by one or more separate pieces connected to the face plate member. The face 112 may alternately be formed as part of a face frame member with the body 108 being partially or wholly formed by one or more separate pieces connected to the face frame member, with a wall or walls extending rearward from the edges of the face 112 (these rearward extending walls also may be referred to as a "return portion"). This configuration may also be known as a "cup face" structure in some configurations. The face frame member may also have an L-shaped configuration. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The golf club 100 may include a shaft 104 connected to or otherwise engaged with the ball striking head 102 as shown in FIG. 1A. The shaft 104 is adapted to be gripped by a user to swing the golf club 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 (FIG. 1A) may be positioned on the shaft 104 to provide a golfer with a slip resistant surface with which to grasp golf club shaft 104. The grip element 105 may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention include a moveable sole portion or sole member, such as a removable and/or adjustable sole member, connected to the sole of the body. For example, the head 102 may include a removable sole member 130 releasably connected to the sole 118 of the body 108, and the removable sole member 130 may form at least a portion of the lowermost surface of the head 102. The removable sole member 130 may also be interchangeable with another sole member 130 having different properties. As another example, the head 102 may include an adjustable sole member 180 (e.g., FIGS. 11-15) that is connected to the sole 118 and moveable between a first position and a second position, and which may form at least a portion of the lowermost surface of the head 102. In one embodiment, the adjustability of the sole member 180 may be used to adjust the lie angle of the head 102, such that the outer surface of the sole member 180 is oriented at a first angle when the sole member 180 is in the first position, and at a second angle when the sole member 180 is in the second position.

The ball striking heads 102 according to the present invention may also contain features on the body 108 that influence the impact of a ball on the face 112, such as one or more compression channels 140 positioned on the body 108 of the head 102 that allow at least a portion of the body 108 to flex, produce a reactive force, and/or change the behavior or motion of the face 112, during impact of a ball on the face 112. In one embodiment, at least a portion of the compression channel(s) 140 may extend parallel or generally parallel to one of the adjacent edges of the face 112. In the golf club 100 shown in FIGS. 1-5, the head 102 includes a single channel 140 located on the sole 118 of the head 102. As described below, this channel 140 permits compression and flexing of the body 108 during impact on the face 112, and can also produce a reactive force that can be transferred to the ball. This illustrative embodiment is described in greater detail below.

The golf club 100 shown in FIGS. 1-5 includes a compression channel 140 positioned on the sole 118 of the head 102, and which may extend continuously across at least a portion of the sole 118. In other embodiments, the head 102 may have a channel 140 positioned differently, such as on the crown 116, the heel 120, and/or the toe 122. It is also understood that the head 102 may have more than one channel 140, or may have an annular channel extending around the entire or substantially the entire head 102. As illustrated in FIGS. 2-5, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 140, 142. In this embodiment, the channel 140 extends adjacent to and parallel or generally parallel to the bottom edge 115 of the face 112, and further extends into the heel 120 and toe 122 areas of the head 102, extending parallel or generally parallel to the heel and toe edges 117, 119 of the face 112. As seen in FIGS. 2-5, the channel 140 is substantially symmetrically positioned on the head 102 in this embodiment. In other embodiments, the channel 140 may be oriented and/or positioned differently. For example, the channel 140 may be oriented to be parallel to a different edge of the face 112, or may not be parallel to any of the edges of the face 112. In a further embodiment, the head 102 may not contain any compression channel 140 as shown in FIGS. 2-5 and described above, nor any similar structure. The size and shape of the compression channel 140, when present, also may vary widely without departing from this invention.

The channel 140 is recessed inwardly with respect to the immediately adjacent surfaces of the head 102 that extend from and/or are in contact with the edges 146, 148 of the channel 140, as shown in FIGS. 2-5. The channel 140 in this embodiment has a generally semi-circular cross-sectional shape or profile, with a trough 150 and sloping, depending side walls 152 that are smoothly curvilinear, extending from the trough 150 to the respective edges 146, 148 of the channel 140. It is understood that the channel 140 may have a different cross-sectional shape or profile, such as having a sharper and/or more polygonal (e.g. rectangular) shape in another embodiment. Additionally, in one embodiment, the wall thickness of the body 108 may be reduced at the channel 140, as compared to the thickness at other locations of the body 108, to provide for increased flexibility at the channel 140. In one embodiment, the wall thickness in the channel 140 is from 0.8-1.5 mm.

In the embodiment shown in FIGS. 2-5, the channel 140 is spaced from the bottom edge 115 of the face 112, with a flattened spacing portion 154 defined between the channel 140 and the bottom edge 115. The spacing portion 154 is located immediately adjacent the channel 140 and junctures with one of the side walls 152 of the channel 140 along the first edge 146 of the channel 140, as shown in FIGS. 2-5. In this embodiment, the spacing portion 154 is oriented at an acute (i.e. <90°) angle to the ball striking surface 110 and extends rearward from the bottom edge 115 of the face 112 to the channel 140. Force from an impact on the face 112 can be transferred to the channel 140 through the spacing portion 154, as described below. In other embodiments, the spacing portion 154 may be oriented at a right angle or an obtuse angle to the ball striking surface 110, and/or the flattened spacing portion 154 may be smaller than shown in FIGS. 2-5 or absent entirely. If desired, as another example, a smoothly curved surface may extend from the bottom edge 115 of the face 112 right into the interior side walls 152 of the channel 140.

Figure 2:
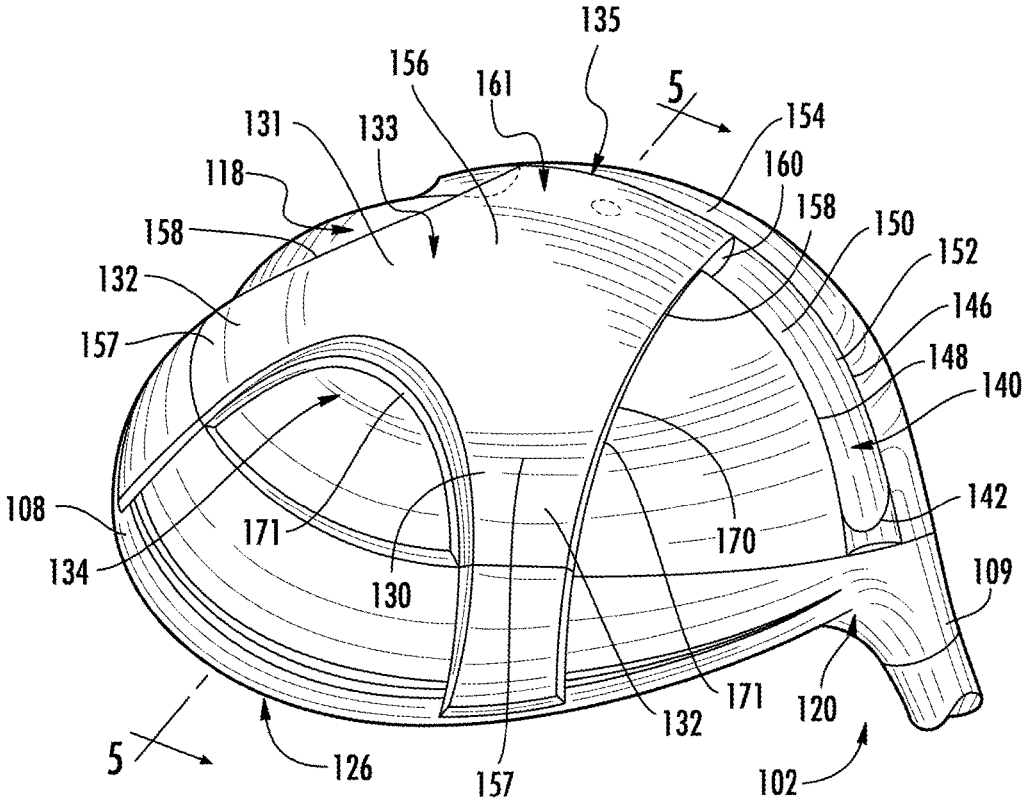
FIG. 2 is a bottom perspective view of the head of FIG. 1.
Figure 3:
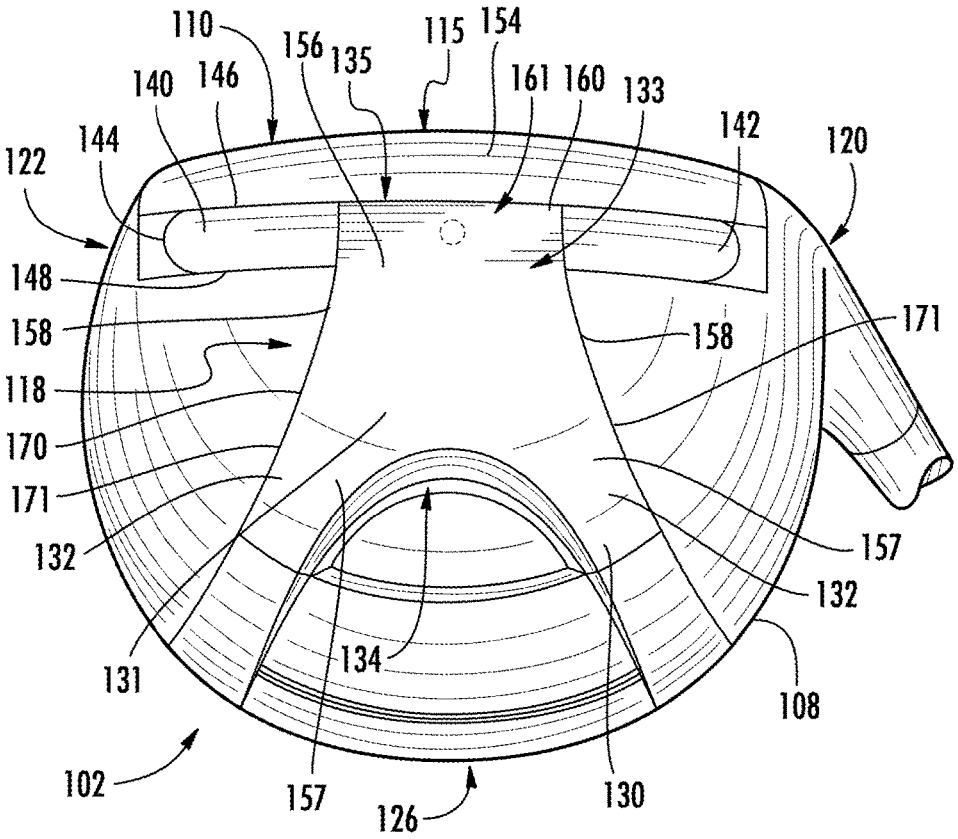
FIG. 3 is a bottom view of the head of FIG. 1.

As also shown in FIGS. 2-5, the sole 118 of the head 102 has a keel 156 that extends rearward on the sole 118. In this embodiment, the keel 156 extends rearward from the channel 140 toward the rear 126 of the head 102. Additionally, the keel 156 forms the lower extremity of the body 108 and faces the playing surface in use, and at least a portion of the keel 156 is raised with respect to adjacent portions of the sole 118. As shown in FIGS. 2-5, at least a portion of the keel 156 is defined by edges formed by shoulders 158 that raise the keel 156 above the adjacent portions of the sole 118 in contact with the shoulders 158. As also seen in FIGS. 2-3, the width of the keel 156 increases toward the rear 126 of the head 102, and the keel 156 splits into two legs 157 that separate further toward the rear 126 of the head 102. In the embodiment shown in FIGS. 1-5, the channel 140 extends across (and beyond) the entire width of the keel 156. The keel 156 may have a smooth contour and texture to provide for decreased friction and/or other forces on the sole 118 if the keel 156 contacts the playing surface in use. Accordingly, forces on the keel 156 which may slow the speed of the head 102, alter the orientation or position of the head 102, and/or otherwise affect the swinging motion of the head 102 can be reduced appreciably. As described below, the keel 156 may be at least partially formed by a moveable sole member, such as a removable sole member 130 as shown in FIGS. 1-10 or an adjustable sole member 180 as shown in FIGS. 11-15.

FIGS. 2-5 illustrate one embodiment of a ball striking head 102 having a removable sole member 130 connected to the sole 118 and forming at least a portion of the lowermost surface of the head 102. In this embodiment, the sole member 130 has a thin, plate-like body or cover member 131 with legs 132 that branch away from each other at the rear end 134 of the sole member 130. The sole member 130 also has a substantially smooth bottom or outer surface 133 such that, when connected to the sole 118 as shown in FIGS. 2-5, the outer surface 133 forms a substantially smooth surface on the bottom of the head 102. In one embodiment, the sole member 130 forms most or all of the keel 156 of the head 102 and forms most or all of the lowermost surface of the head 102 in typical use. The outer surface 133 of the sole member 130 may also be considered to form part of the sole 118 of the head 102. Additionally, in one embodiment, the outer surface 133 of the sole member 130 is raised with respect to at least some of the adjacent surfaces of the body 108. In the embodiment shown in FIGS. 2-5, the outer surface 133 is raised with respect to all or substantially all of the adjacent surfaces of the body 108 on the rearward side of the channel 140, and the outer surface 133 is substantially flush with the spacing portion 154 at the front end 135 of the sole member 130. In other embodiments, the sole member 130 may have a different size, shape, and/or orientation, and may cover a different portion or proportion of the sole 118.

The sole member 130 may also include a plug or insert member 160 that extends into the channel 140 and at least partially fills at least a portion of the channel 140. In the embodiment of FIGS. 2-5, the sole member 130 includes a plug 160 at the front end 135, and the plug 160 is contoured similarly to the channel 140, such that the plug 160 fills or substantially fills the channel 140 along a portion of the length of the channel 140. In one embodiment, such as shown in FIGS. 2-5, the plug 160 engages the side walls 152 and the trough 150 of the channel 140 to fill or substantially fill the portion of the channel 140, such that the plug 160 is substantially flush with at least one or both edges 146, 148 of the channel 140. As shown in FIGS. 2 and 5, in this embodiment, the plug 160 forms part of the smooth outer surface 133 of the sole member 130, and the plug 160 is flush with the spacing portion 154 and the front edge 146 of the channel 140 at the front end 135 of the sole member 130. This configuration creates a smooth keel 156 and lowermost surface of the head 102 that extend rearwardly from the lower edge 115 of the face 112, reducing undesirable interaction with the playing surface and/or debris. In other embodiments, the plug 160 may not completely fill the portion of the channel 140 and/or may be received in a larger or smaller portion of the channel 140. In an alternate embodiment, the plug 160 may not have any portion that extends into the channel 140, and may thereby act as a bridge over the channel 140. The plug 160 in such a configuration may still be considered to "fill" a small portion at the extremity of the channel 140. In a further embodiment, the head 102 may have multiple channels 140, and the sole member 130 may have multiple plugs 160 engaging and/or at least partially filling some or all of the channels 140. Such multiple channels 140 may extend generally parallel to each other in a bellows-like configuration in one embodiment, and the sole portion 130 may have plugs 160 that at least partially fill some or each of the channels 140.

In one embodiment, as shown in FIGS. 4 and 5, the head 102 may include a receiver 170 in the form of a recess on the sole 118 to receive at least a portion of the sole member 130. The receiver 170 shown in FIG. 4 is shaped similarly to the peripheral shape of the sole member 130 so that the sole member 130 fits securely in the receiver 170. The shape of the receiver 170 is defined by edges 171 that extend across the sole 118 and intersect with the rear edge 148 of the channel 140 in this embodiment. The sole member 130 in the embodiment of FIGS. 2-5 has a thickness that is greater than the depth of recess of the receiver 170 so that the sole member 130 fills the receiver 170, and portions of the sole member 130 project outwardly from the adjacent surfaces of the body 108. It is understood that the receiver 170 may be differently configured in other embodiments, and that the head 102 may have no receiver 170 in a further embodiment.

The sole member 130 may be connected to the head 102 in a variety of different manners, including removable configurations that permit removal of the sole member 130 and interchanging with a second sole member 130. The head 102 and the sole member 130 may have complementary connecting structure for such a purpose, and the connecting structure of the head 102 may be associated with and/or partially contained within the receiver 170 in some embodiments. Such connecting structure may be in the form of a releasable connection mechanism. In the embodiment illustrated in FIGS. 2-5, the sole member 130 includes one or more posts 136 on the inner surface of the sole member 130 that are received in holes or apertures 137 in the sole 118 to form a releasable connection mechanism removably connecting the sole member 130 to the body 108. Each post 136 in this embodiment has an enlarged head 138 that engages the aperture 137 and/or the inner surface of the body 108 to retain the post 136 in the aperture 137. Each post 136 may be at least partially made of a resilient material (e.g. at least the head 138) that permits the enlarged head 138 of the post 136 to be forced through a smaller aperture 137 without damage to the post 136. In the embodiment of FIGS. 2-5, the sole member 130 has three posts 136, with one post 136 located near the rear end 134 of the sole member 130 on each of the legs 132 and another post 136 located near the front end 135 of the sole member 130 on the plug 160. The body 108 has apertures 137 located in complementary positions, with two apertures 137 located near the rear 126 of the head 102 and a third aperture 137 located within the channel 140 and configured to receive the post 136 located on the plug 160. The engagement between one of the posts 136 and the aperture 137 is illustrated in greater detail in FIG. 5. It is understood that the sole member 130 may be removed from the body 108 by pulling the posts 136 out of the apertures 137. In other embodiments, the location(s) and/or number of the post(s) 136 and aperture(s) 137 may be different, and the orientations of one or more of the post(s) 136 and aperture(s) 137 may be transposed.

Figure 7:
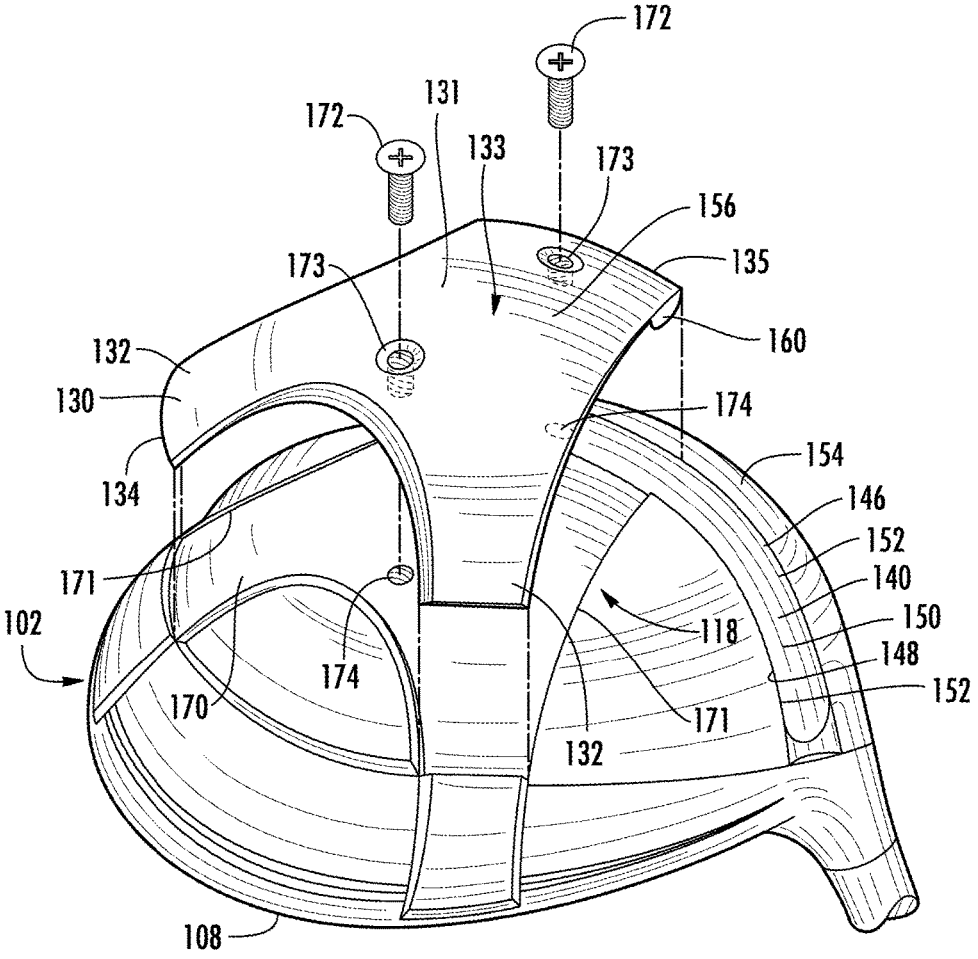
FIG. 7 is a bottom perspective view of another illustrative embodiment of a head of a ball striking device according to the present invention, showing the connection of a removable sole member to the head.
Figure 8:
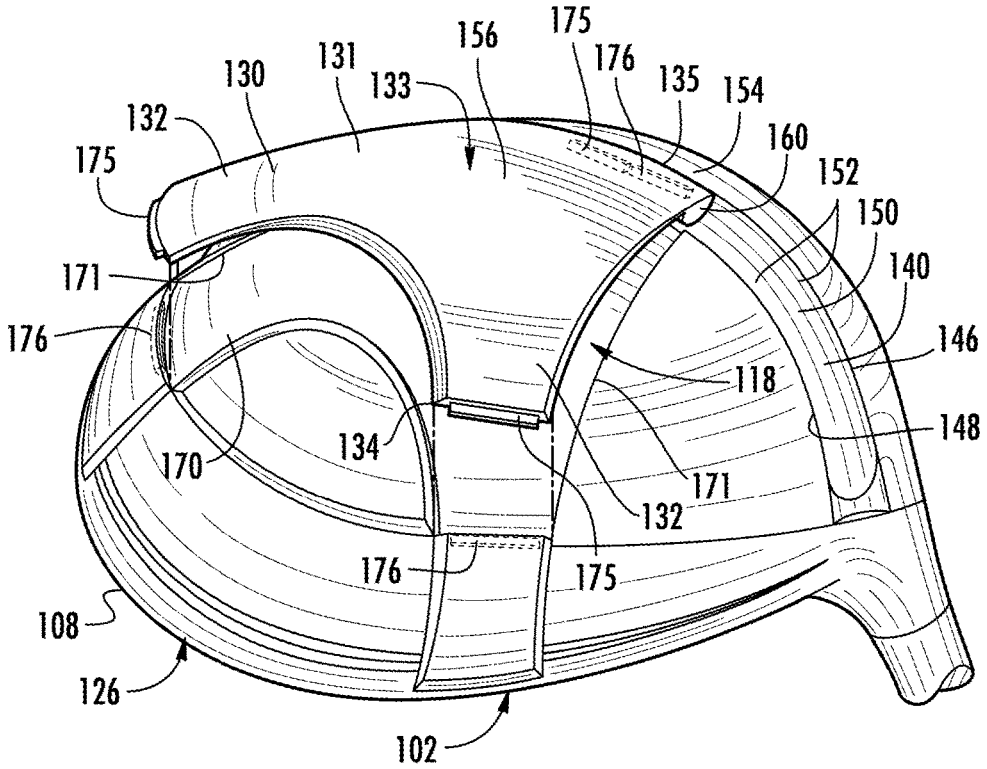
FIG. 8 is a bottom perspective view of another illustrative embodiment of a head of a ball striking device according to the present invention, showing the connection of a removable sole member to the head.

In further embodiments, a different connecting structure may be used, including additional releasable connection mechanisms. For example FIGS. 7 and 8 illustrate embodiments of heads 102 having removable sole members 130 configured similarly to the sole member 130 of FIGS. 2-5, utilizing different releasable connection mechanisms. In the embodiment of FIG. 7, the releasable connection mechanism includes threaded fasteners 172 (e.g. bolts or screws) that extend through holes 173 in the sole member 130 and holes 174 in the body 108 to removably connect the sole member 130 to the sole 118. It is understood that the holes 174 in the body 108 may be threaded for engagement with the fasteners 172, and the holes 173 in the sole member 130 may be threaded as well. As shown in FIG. 7, the holes 173 in the sole member 130 may be countersunk to receive the heads of the fasteners 172. Additional engagement or alignment structure may be included between the sole member 130 and the body 108 in order to facilitate alignment of the holes 173, 174, in another embodiment. The sole member 130 may be removed by loosening the fasteners 172. In the embodiment of FIG. 8, the releasable connection mechanism includes tabs 175 located on the sole member 130 and complementary slots 176 located on the body 108. The tabs 175 fit within the slots 176 to secure the sole member 130 to the body 108 in this configuration. As shown in FIG. 8, in this embodiment, the sole member 130 has tabs 175 located at the rear end 134 of the sole member 130, on the ends of each of the legs 132, and a third tab 175 located at the front end 135 of the sole member 130, at the front of the plug 160. The body 108 includes slots 176 in complementary locations, including two slots 176 near the rear 126 of the head 102 and a third slot 176 located in one of the side walls 152 of the channel, adjacent the front edge 146, in this embodiment. As shown in FIG. 8, the sole member 130 may be connected by first inserting the tab 175 at the front end 135 of the sole member 130 into the corresponding slot 176, and then pivoting the rear end 134 of the sole member 130 toward the body 108 to press the other two tabs 175 into the slots 176. The sole member 130 may be removed in the opposite way in one embodiment, by prying the rear end 134 of the sole member 130 away from the body 108, although other removal techniques may be used. In another embodiment, the tabs 175 may be connected in the opposite order, i.e. by inserting the tabs 175 at the rear end 134 into the respective slots 176, and then subsequently inserting the tab 175 at the front end 135 into its slot 176. Thus, attachment and removal of the sole member 130 may take place in a manner generally akin to opening and closing a battery compartment of certain electronic devices. It is understood that some or all of the tabs may have ramps or other features to ease insertion of the tabs 175, and that the tabs 175 and/or other portions of the sole member 130 may have resiliency to facilitate repeated insertion and removal. In yet another embodiment, the locations of at least some of the tabs 175 and the slots 176 may be transposed, such that at least one of the tabs 175 may be located on the sole 118 and at least one of the slots 176 may be located on the sole member 130. In a further example, a bonding material (e.g. adhesive) may be used to connect the sole member 130 to the body 108, in addition to or instead of the connections described above. Still other connection configurations may be used, including configurations that utilize different types of fasteners or other separate and/or integral connection members, and configurations that utilize multiple different types of releasable connection mechanisms or other connecting structures, including combinations of the various mechanisms and structures described above.

The sole member 130 may be made from a variety of different materials or combinations of materials. In one embodiment, at least the cover member 131 of the sole member 130 may be formed of a metallic material, such as aluminum, titanium, stainless steel, or other metals and/or alloys. In another embodiment, part or all of the sole member 130 may be formed of a polymeric material (e.g. various high strength polymers), a composite material (e.g. carbon fiber composites or other fiber/matrix composites), or another suitable material. Portions of the sole member 130 may be made from different materials than the cover member 131 in some embodiments. For example, the posts 136 in the embodiment of FIGS. 2-5 may be formed of a resilient polymer material in one embodiment. As another example, the plug 160 may be at least partially formed of a resiliently deflectable material, e.g. polyurethane rubber or another similar flexible polymer material, in one embodiment. The plug 160 may include one or more rigid components in one embodiment as well. Additionally, different portions of the cover member 131 of the sole member 130 may be formed of different materials. Further, the sole member 130 may include a coating or plating on the outer surface 133 in one embodiment, in order to increase the smoothness of the surface.

The compression channel 140 and the plug 160 on the head 102 shown in FIGS. 2-5 can influence the impact of a ball (not shown) on the face 112 of the head 102, as similarly described in U.S. patent application Ser. No. 13/015,264, filed Jan. 27, 2011, which is incorporated by reference herein in its entirety. In one embodiment, the channel 140 can influence the impact by flexing and/or compressing in response to the impact on the face 112, and/or by exerting a reaction force on the face 112 during impact. For example, when the ball 106 impacts the face 112, the face 112 flexes inwardly. Additionally, some of the impact force is transferred through the spacing portion 154 to the channel 140, causing the sole 118 to flex at the channel 140. This flexing of the channel 140 may result in a smaller degree of deformation of the ball as compared to a traditional head, which can assist in achieving greater impact efficiency and greater energy and velocity transfer to the ball during impact. The more gradual impact created by the flexing also creates a longer impact time, which can also result in greater energy and velocity transfer to the ball during impact. The plug 160 may also compress and/or deform with the compression of the channel 140. Further, as the compressed channel 140 and plug 160 expand to return to their initial shapes, a responsive or reactive force is exerted on the face 112, creating an increased "trampoline" effect, which can result in greater energy and velocity transfer to the ball 106 during impact. The plug 160 may be formed at least partially of a resiliently deflectable material to enhance this response effect in one embodiment. Still further, because the channel 140 extends toward the heel 120 and toe 122, and overlaps the heel and toe edges 117, 119 of the face 112, the head 102 can achieve increased energy and velocity transfer to the ball for impacts that are away from the center or traditional "sweet spot" of the face 112. It is understood that a channel 140 may be additionally or alternately incorporated into the crown 116 and/or sides 120, 122 of the body 108 in order to produce similar effects for energy and velocity transfer. It is understood that the head 102 may have one or more channels 140 in a different configuration in other embodiments, including embodiments where one or more channels 140 are separate from the sole member 130.

A specific plug 160 having a desired flexibility and/or other characteristic(s) may be chosen to provide a desired performance by the channel 140 and/or the face 112, thereby "tuning" the channel 140 for a specific objective. For example, a plug 160 can be chosen based on its flexibility to achieve a flexibility of the channel 140 that controls the response of the face 112 so as to be as close as possible to the prevailing USGA limit for COR. As another example, a plug 160 can be chosen to customize the performance of the channel 140 and the face 112 to a particular user's swing characteristics. As some examples, a golfer with a slow swing speed may benefit from a softer or more flexible insert 160, and a golfer with a higher swing speed may benefit from a more hard or rigid insert 160.

The sole member 130 can also assist in reducing or eliminating drag or other forces between the bottom of the head 102 and the playing surface in use. When hitting a ball on a playing surface, the channel 140 may tend to catch or drag along the playing surface during a swing. The plug 160 fills and/or covers the channel 140 at the center of the sole 118 and/or across the lowest point on the sole 118 (e.g. the keel 156), which assists in minimizing or eliminating any interaction between the channel 140 and the playing surface in use, which may exert increased drag or other forces on the club head 102. Accordingly, forces on the bottom of the club head 102 which may slow the speed of the head 102, alter the orientation or position of the head 102, and/or otherwise affect the swinging motion of the head 102 can be reduced appreciably. As described above, the sole member 130 may have a smooth outer surface 133 in one embodiment that can assist in reducing the drag and other forces, by providing a smooth, rigid surface that can glide along the playing surface more easily. This configuration may create a smooth keel 156 that can further assist in decreasing such drag or other forces. Additionally, the fact that the outer surface 133 of the sole member 130 is substantially flush with the spacing portion 154 creates a smoother surface that is less prone to creation of drag forces during contact with the playing surface. Accordingly, the head 102 described above can provide advantages when incorporated into fairway woods, hybrid clubs, or other such golf clubs which may be used to hit a ball sitting directly on a playing surface, resulting in possible contact between the bottom of the club head 102 and the playing surface in use. Nevertheless, it is understood that the features described herein can be advantageous when incorporated into a different type of golf club, including a driver or non-wood-type clubs such as irons and putters, as well as other ball striking devices.

As described above, the embodiments of FIGS. 2-8 include sole members 130 that are removable after connection to the body 108 and can be replaced with a different sole member 130 that may have a similar connecting structure and/or shape (e.g., a similar perimeter shape to fit in receiver 170). The second sole member 130 may have at least one property that is different from the original sole member 130. Examples of such different properties include: a different weight and/or weight distribution; at least a portion formed of a different material; a different profile or contour on the outer surface 133 and/or on another surface; a different surface texture, smoothness, and/or friction property on the outer surface 133; a plug 160 that has a different structural and/or material configuration, such as having a different flexibility or being configured to fill and/or occupy a different portion or proportion of the channel; another type of additional or alternate structural feature; or any combination of such features. It is understood that the above list is not exhaustive.

Figure 6:
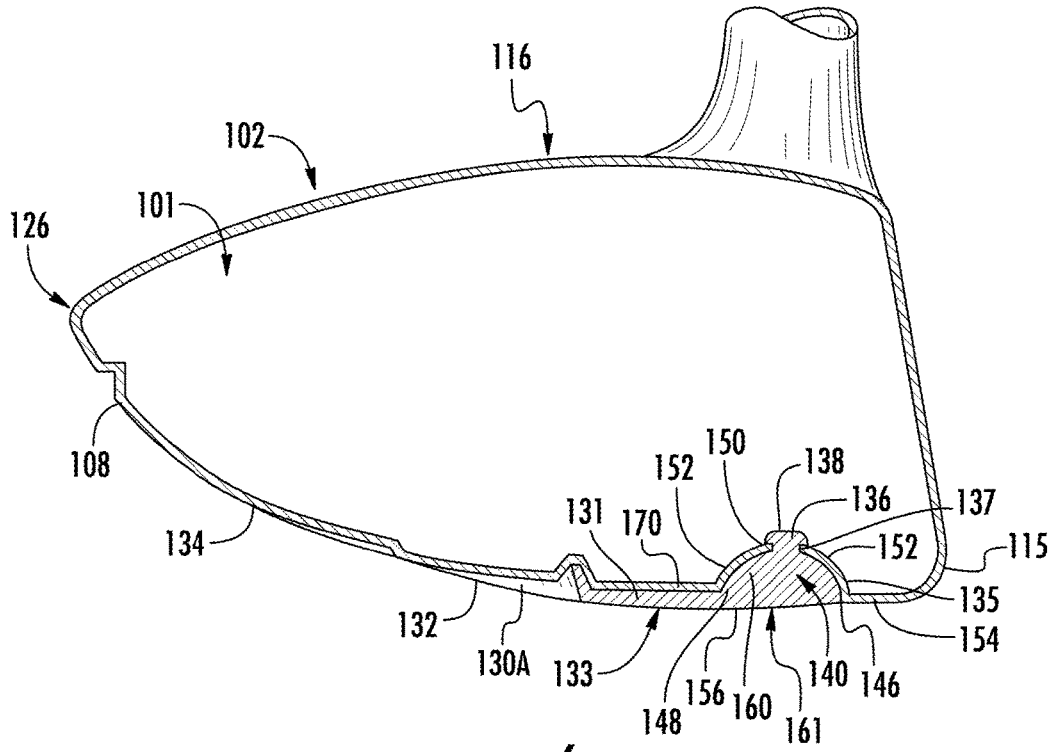
FIG. 6 is a cross-section view of the head as shown in FIG. 5, having another embodiment of a removable sole member connected to the head.

In one embodiment, as illustrated in FIG. 6, the sole member 130 in FIGS. 2-5 may be replaced with a second sole member 130A that has an outer surface 133 that is angled differently from the original sole member 130. For example, the second sole member 130A may create a different lie angle for the head 102 (e.g. the angle between the bore of the shaft 104 and the lowermost surface of the head (e.g. the outer surface 133 of the sole member 130). As another example, the second sole member 130A may have an outer surface 133 with a different surface angle as compared to the first sole member 130, which may in turn create a different lie angle for the head 102. The surface angle may be defined as the angle between the outer surface 133 of the sole member 130 and an adjacent surface of the body 108 or the angle between the outer surface 133 of the sole member 130 and the striking surface 110. In the case of curved or other contoured surfaces, a plane tangent to the surface in question may be used to measure the angle. As illustrated in FIG. 6, the surface angle of the lowermost surface of the head 102 is changed at least in the front 124 to rear 126 direction. However, it is understood that the surface angle of the lowermost surface may additionally or alternately be changed in the heel 120 to toe 122 direction. The sole member 130A as shown in FIG. 6 may be connectable and removable with respect to the head 102 in the same manner as the sole member 130 of FIGS. 2-5, as described above. It is understood that the head 102 may be provided with the second sole member 130A as shown in FIG. 6 in one embodiment, rather than the second sole member 130A being a replacement for the sole member 130 in FIGS. 2-5.

Figure 9:
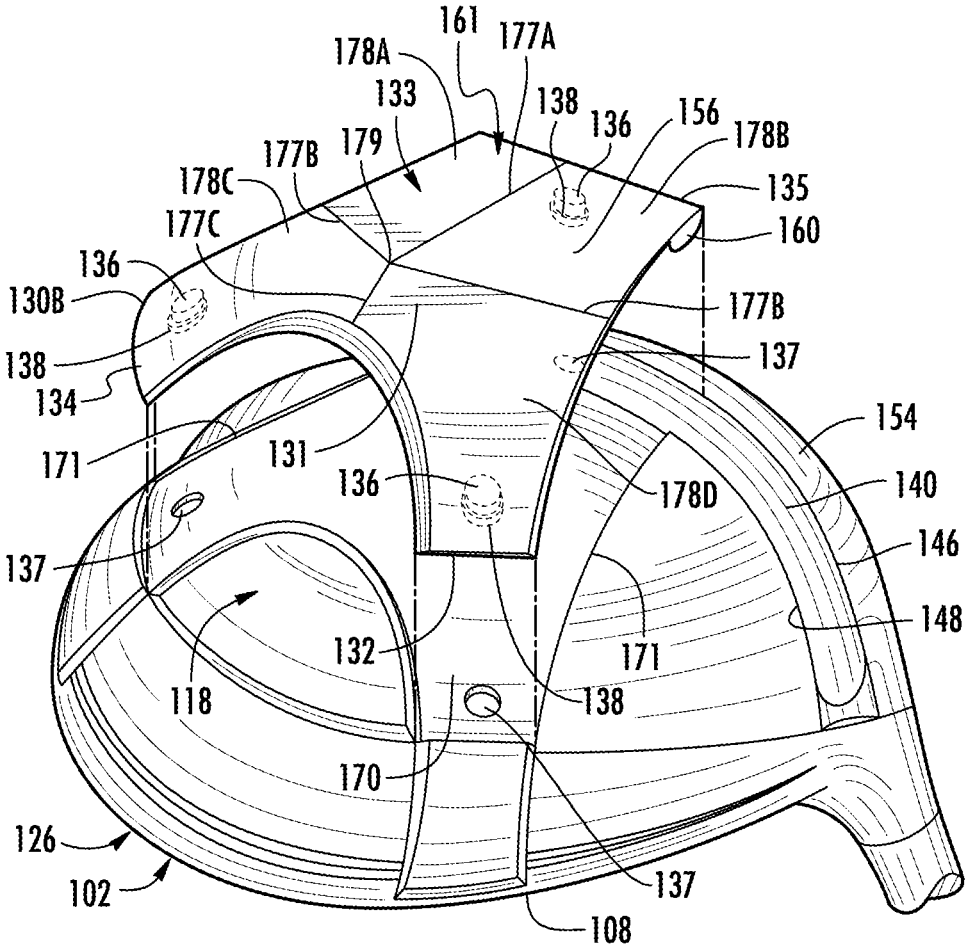
FIG. 9 is a bottom perspective view of another illustrative embodiment of a head of a ball striking device according to the present invention, showing the connection of a removable sole member to the head.

In another embodiment, as illustrated in FIG. 9, the sole member 130 may be replaced with a third sole member 130B that has an outer surface 133 with a different surface profile and/or contour as compared to the first sole member 130, to create a differently shaped keel 156 for the head 102. In this embodiment, the outer surface 133 of the sole member 130B has four substantially smooth, substantially planar surfaces 178A-D that are oriented at slight obtuse angles to each other. Two front surfaces 178A-B extend rearward from the front edge 135 of the sole member 130B and converge to form a center ridge 177A approximately at the centerline of the sole 118. The center ridge 177A is adapted to form the lowest point on the head 102 when the head 102 is in use. The rear surfaces 178C-D are oriented at slight angles to each other and also at slight angles to the front surfaces 178A-B. As a result, the rear surfaces 178C-D converge with the front surfaces 178A-B to form ridges 177B extending toward the heel 120 and the toe 122 of the head, and also converge with each other to form a second center ridge 177C that is aligned with the center ridge 177A. All of the ridges 177A-C extend outwardly from a convergence point 179 where all four smooth planar surfaces 178A-D converge. Thus, in this configuration, the sole member 130B forms a keel 156 with a substantially smooth surface extending from the bottom edge 115 of the face 112 toward the rear 126 of the head 102. As such, the keel 156 of the head 102 in FIG. 9 has a substantially smooth surface texture as well as a substantially smooth contour. As similarly described above, the smooth contour and texture of the substantially smooth surface of the keel 156 provide for decreased friction and/or other forces on the sole 118 if the sole 118 contacts the playing surface in use. Additionally, in this configuration, the center ridge 177A is able to glide along the playing surface, and this ridge 177A, along with the planar surfaces 178A-D, is able to push foreign objects (e.g. grass, debris, etc.) to the sides during the swing, to reduce potential interference. The sole member 130B as shown in FIG. 9 may be connectable and removable with respect to the head 102 in the same manners as the sole members described above. It is understood that the head 102 may be provided with the third sole member 130B as shown in FIG. 9 in one embodiment, rather than the third sole member 130B being a replacement for one of the sole members 130, 130A in FIGS. 2-6. It is also understood that the head 102 of FIGS. 1-5 may be provided as a kit with two or more of the sole members 130, 130A, 130B of FIGS. 2-9 and/or other sole members that are connectable to the head 102, to be alternately connected and/or interchanged to produce different properties on the head 102.

Figure 10:
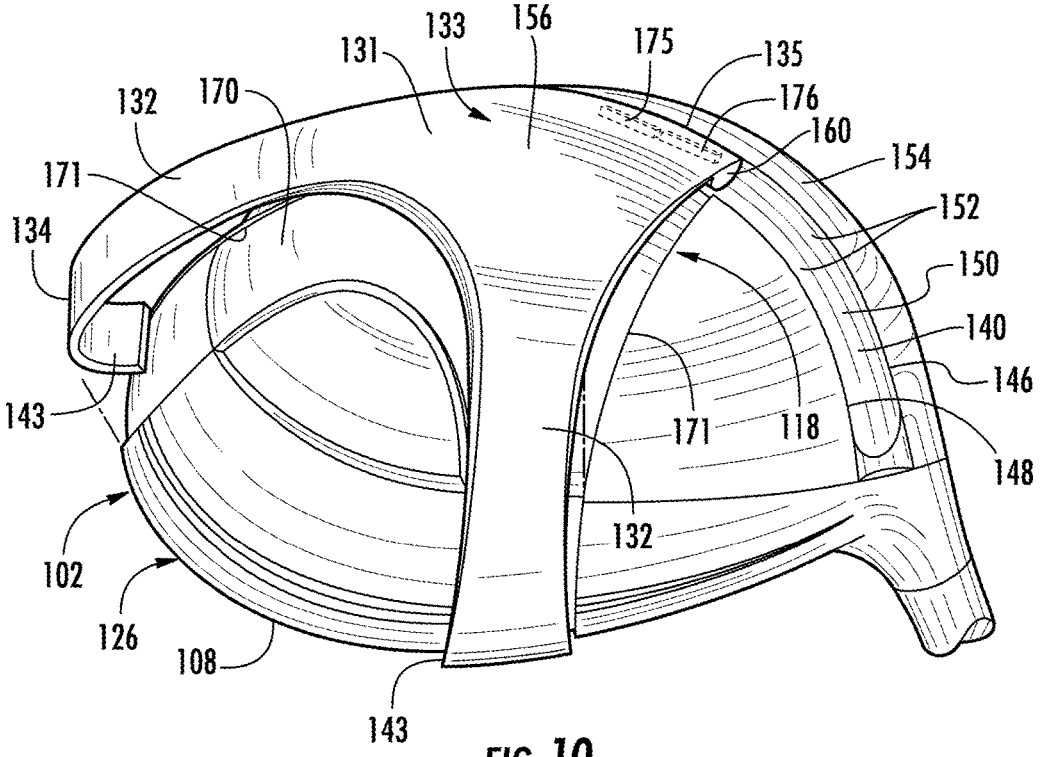
FIG. 10 is a bottom perspective view of another illustrative embodiment of a head of a ball striking device according to the present invention, showing the connection of a removable sole member to the head.

FIG. 10 illustrates another embodiment of a head 102 having a removable sole member 130 having certain features in common with the heads 102 and the sole members 130 of FIGS. 2-5 and 8, utilizing different connecting structures and a different mounting configuration between the head 102 and the sole member 130. Such shared features may not be described again or may be described again in lesser detail for the sake of brevity. The head 102 of FIG. 10 includes a removable sole member 130 that has a releasable connection mechanism including two legs 132 that extend rearwardly around the back or rear end 126 of the head 102 to connect the sole member 130 to the body 108. Each of the legs 132 in this embodiment has an arm 143 at the rear 134 of the sole member 130, forming a hook-like structure to wrap around at least a portion of the body 108. As shown in FIG. 10, in this embodiment, the arms 143 wrap around the largest/outermost periphery of the head 102 and engage a portion of the crown 116. The front end 135 of the sole member 130 has additional connecting structure which, in this embodiment, is in the form of a tab 175 that is received in a slot 176, similarly to the embodiment of FIG. 8. The sole member 130 may have multiple tabs 175 and slots 176, and/or the tab(s) 175 may be positioned at different location(s) on the body 108 in other embodiments. In one embodiment, the sole member 130 can be connected to the body 108 by wrapping the arms 143 around the rear 126 of the body 108 and then inserting the tab 175 in the slot 176, and in another embodiment, the sole member 130 can be connected by first inserting the tab 175 in the slot 176 and then wrapping the arms 143 around the rear 126 of the body 108. The tab 175, the legs 132, the arms 143, and/or other portions of the sole member 130 and/or the club head 102 may be formed of a resilient material for purposes of assisting this connection, in one embodiment. In a further embodiment, the sole member 130 in FIG. 10 may have different connecting structure, such as one or more posts 136 (FIGS. 2-5), fasteners 172 (FIG. 7), or other connecting structure(s), which may be included in place of or in addition to the tab(s) 175. It is understood that the locations of the tab 175 and the slot 176 may be transposed between the body 108 and the sole member 130.

The body 108 in the embodiment of FIG. 10 includes a channel 140 as similarly described above and shown in FIGS. 2-5, and also includes a receiver 170 that is shaped complementarily with the sole member 130. The receiver 170 in this embodiment extends completely to the largest/outermost periphery of the head 102 at the rear 126 and may further extend on at least a portion of the crown 116 in one embodiment. Additionally, in this embodiment, the sole member 130 includes a plug 160 that is similar in structure and function to the plugs 160 described above with respect to FIGS. 1-9, at least partially filling at least a portion of the channel 140.

Another embodiment of a head 102 according to aspects of the present invention, having a moveable and/or adjustable sole member 180, is illustrated in FIGS. 11-14. The head 102 in FIGS. 11-14 shares many features in common with the heads 102 illustrated in FIGS. 2-10 and described above, and such shared features are referred to herein using similar reference numerals and may not be described again or may be described again in lesser detail for the sake of brevity. In general, the sole member 180 is moveable between at least a first position and a second position to change the angle and/or contour of at least a portion of the lowermost surface of the head 102 (e.g. the keel 156), such as adjusting a lie angle of the head in one embodiment. In the embodiment of FIGS. 11-14, the outer surface 133 of the sole member 180 is oriented at a first surface angle when in the first position, and the outer surface 133 of the sole member 180 is oriented at a second surface angle when in the second position. As described above, the surface angle may be defined as the angle between the outer surface 133 of the sole member 180 and an adjacent surface of the body 108 or the angle between the outer surface 133 of the sole member 180 and the striking surface 110. In this embodiment, the head 102 has a first lie angle in the first position and a second lie angle in the second position.

The moveable sole member 180 is moveably connected to the body 108 by connecting structure, which is in the form of a post 136 that is received in a hole or aperture 137 in the sole 118 in the embodiment of FIG. 10. This post 136 forms a pivot or rotation point for the sole member 180 to rotate with respect to the body 108. As seen in FIGS. 13-14, the post 136 in this embodiment has an enlarged head 138 that engages the aperture 137 and/or the inner surface of the body 108 to retain the post 136 in the aperture 137, similar to the posts 136 in FIGS. 2-5. The post 136 may be at least partially made of a resilient material that permits the enlarged head 138 of the post 136 to be forced through the smaller aperture 137 without damage to the post 136, as also described above. Additionally, the moveable sole member 180 may be at least partially received in a receiver 170 on the sole 118 of the head 102. The receiver 170 may be recessed with respect to adjacent surfaces of the body 108 and may be defined by one or more peripheral edges 171, as illustrated in FIGS. 11-14. In the embodiment of FIGS. 11-14, the sole member 180 is moveably received in a receiver 170 on the body 108, such that the sole member 180 may be moved by rotation between two or more different positions relative to the body 108. The aperture 137 is located within the receiver 170 in this embodiment. It is understood that the receiver 170 may be differently configured in other embodiments and that the head 102 may have no receiver 170 in a further embodiment. In one embodiment, the sole member 180 is freely rotatable with an infinite degree (e.g. 360°) of free movement. In an alternate embodiment, the sole member 180 and/or the receiver 170 may have structure to limit the total degree of rotation of the sole member 180, such as tabs, buffers, or other such structures, as well as locking structures to lock the sole member 180 in a specific rotational position, including in a discreet, finite number of specific rotational positions (e.g., from 2 to 16 rotational positions).

In another embodiment, a different moveable connecting structure between the sole member 180 and the body 108 may be utilized. For example, in the embodiment illustrated in FIG. 15, the head 102 includes a receiver 170 with one or more slots 181, and the sole member 180 includes one or more flanges 182 that is/are received in the slot(s) 181. The flange(s) 182 can slide within the slot(s) 181 to permit rotation of the sole member 180. The sole member 180 may have a single flange 182 extending around at least a portion of the side of the sole member 180 in one embodiment, or may have multiple flanges 182 extending from different portions of the sole member 180 in another embodiment. The flange(s) 182 may be spring mounted to move inwardly and outwardly for disengaging and engaging the slot(s) 181. The slot(s) 181 and/or the flange(s) 182 may have structure to limit the total degree of rotation of the sole member 180 in one embodiment, such as by using one or more slots 181 having a length designed to create rotational limits. Additional different connecting structures, or combinations of connecting structures, may be utilized in further embodiments, and such connecting structures may permit movement by rotation/pivoting or other movement mechanisms. For example, the connecting structure may permit the sole member 180 to move by sliding, revolving/orbiting, flipping (which may be considered rotation on a different axis), etc. In one example, the sole member 180 may be a symmetrical member that can be moved by removal from the body 108 and re-connecting in a different position, such as a square member that can be connected in four different positions rotated 90° from each other. Further moveable embodiments and configurations exist and are recognizable to those skilled in the art.

Figure 11:
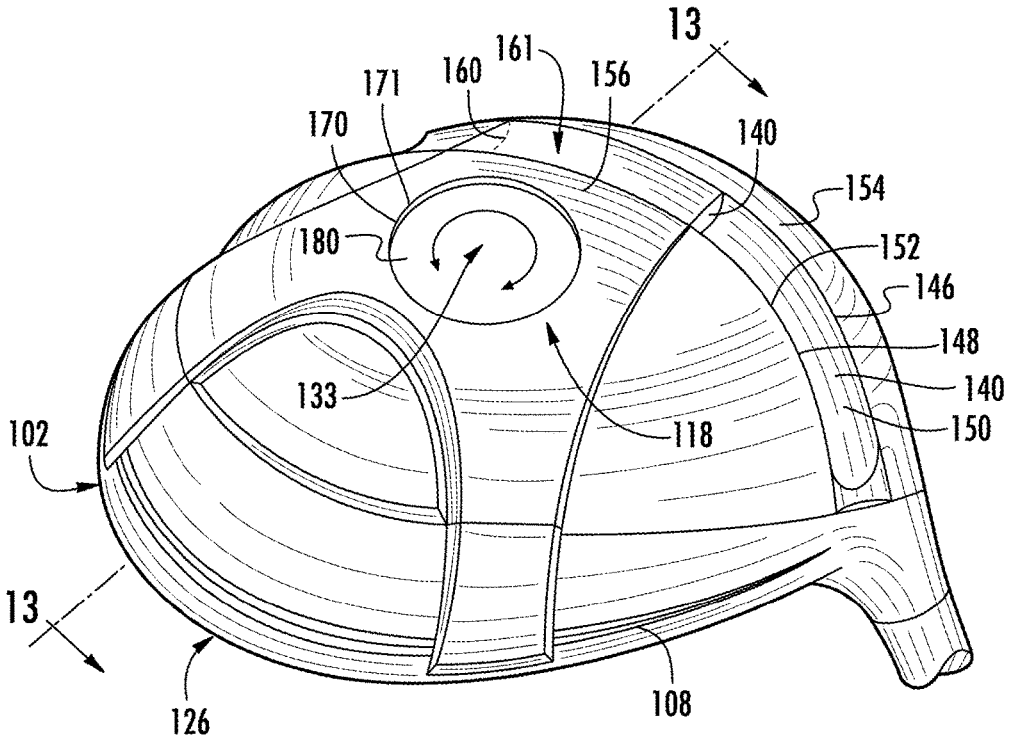
FIG. 11 is a bottom perspective view of another illustrative embodiment of a head of a ball striking device according to the present invention, showing movement of an adjustable sole member.
Figure 12:
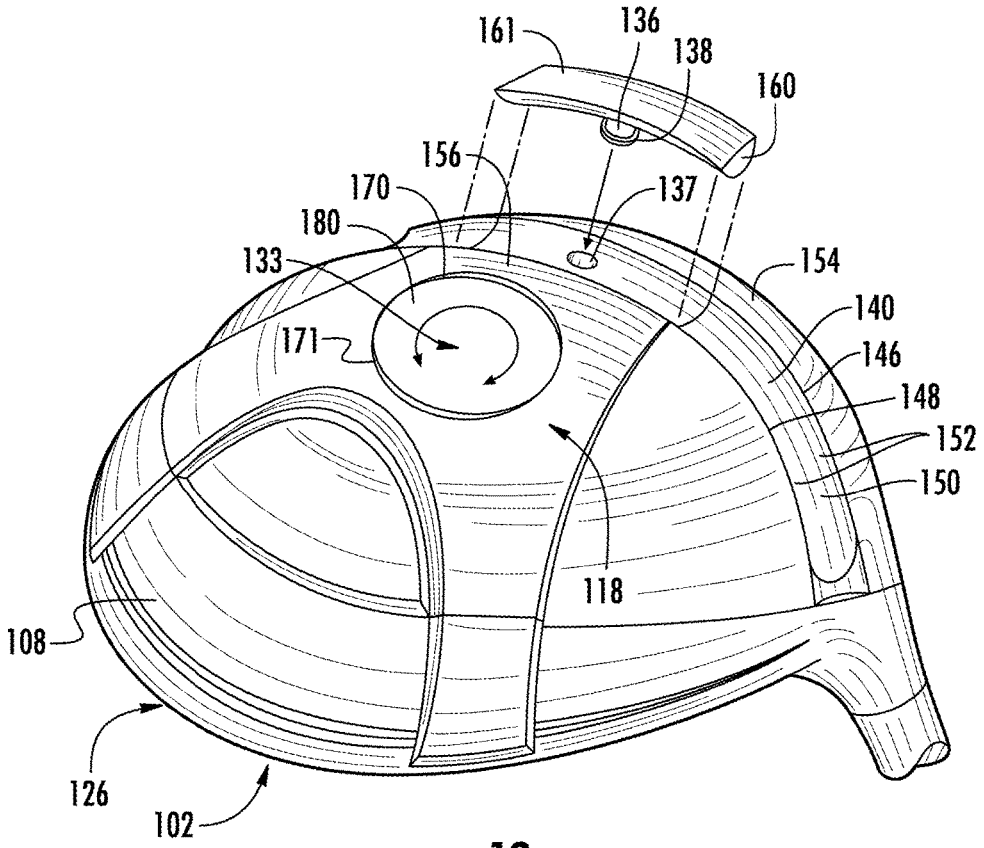
FIG. 12 is a bottom perspective view the head of FIG. 11, showing the connection of a plug to the head.
Figure 13:
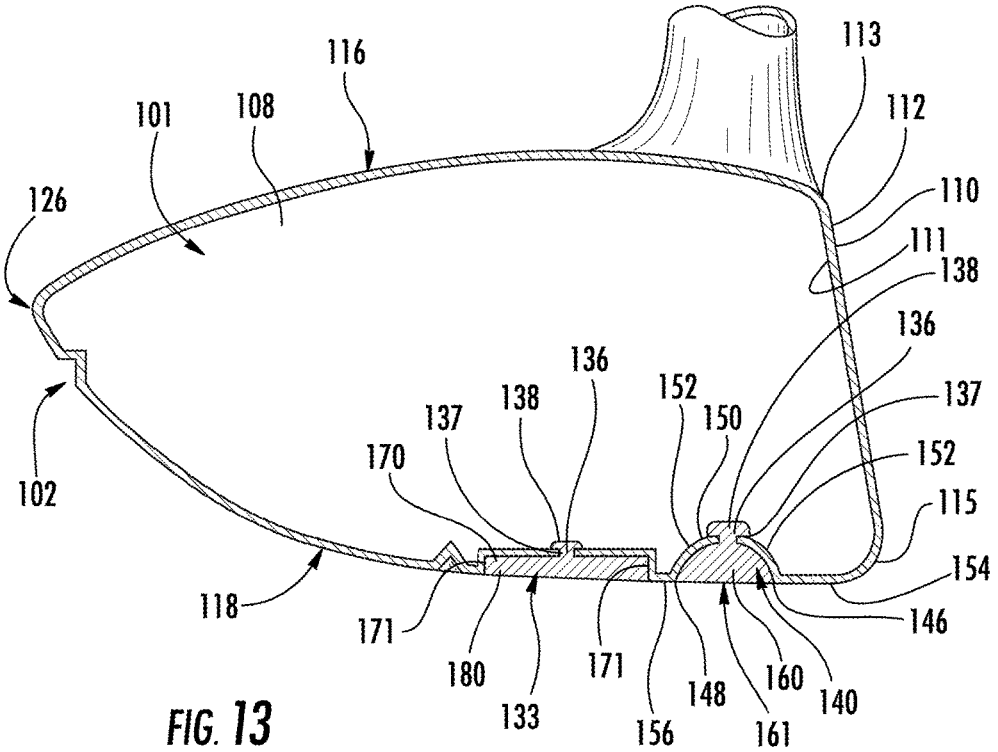
FIG. 13 is a cross-section view of the head of FIG. 11, taken along lines 13-13 of FIG. 11.
Figure 14:
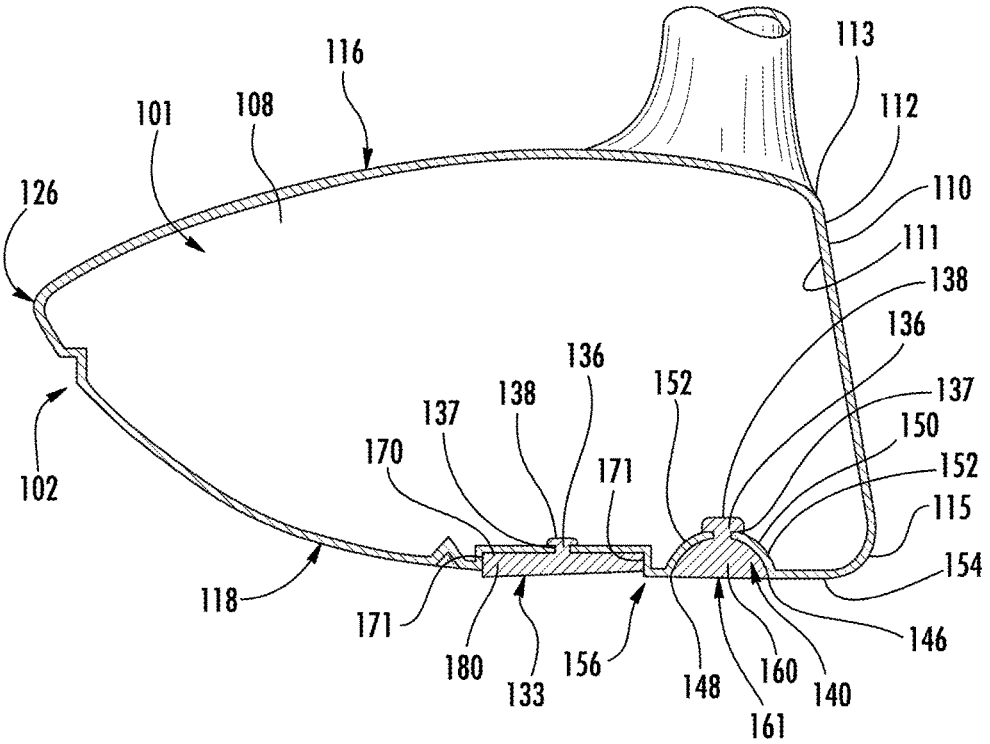
FIG. 14 is a cross-section view of the head as shown in FIG. 13, with the adjustable sole member being moved to a different position.
Figure 15:
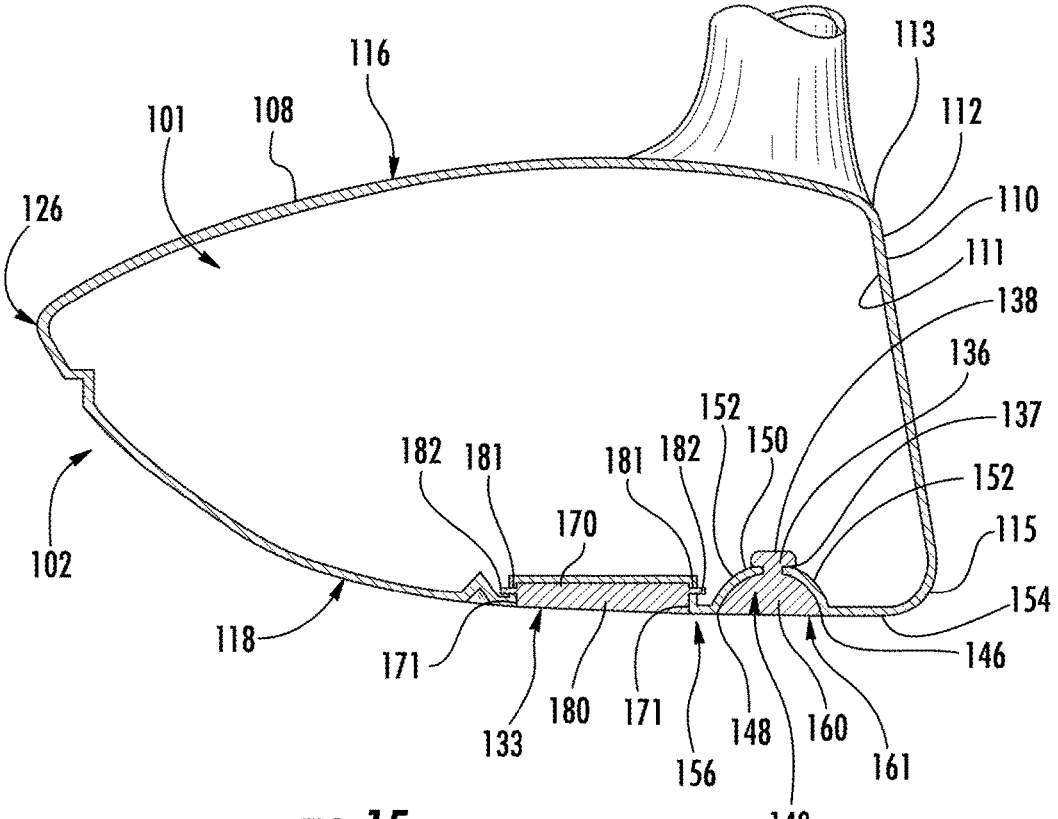
FIG. 15 is a cross-sectional view of another illustrative embodiment of a head of a ball striking device according to the present invention, having another embodiment of an adjustable sole member.

The sole member 180 in the embodiment of FIGS. 11-14 forms at least a portion of the lowermost surface of the head 102, and also forms a portion of the keel 156 of the head 102. As seen in FIGS. 11-12, the sole member 180 is positioned approximately centered along the centerline of the head 102 in this embodiment. As described above, the sole member 180 is moveable between at least a first position and a second position relative to the body 108, such that the outer surface 133 of the sole member 180 is oriented at a first surface angle when in the first position, and the outer surface 133 of the sole member 180 is oriented at a second surface angle when in the second position. In the embodiment of FIGS. 11-14, the sole member 180 is moveable by rotation centered at the post 136 between a large number of different positions. As seen in FIGS. 13-14, in one position (FIG. 13), the outer surface 133 of the sole member 180 forms a first surface angle, and in another position (FIG. 14) rotated 180° from the position of FIG. 13, the outer surface 133 of the sole member 180 forms a different surface angle. This change in surface angle can change the relative angle of the keel 156 and/or the lowermost surface of the head 102, and can thereby change the lie angle of the head 102. In this embodiment, the head 102 has a first lie angle in the first position and a second lie angle in the second position. The sole member 180 may be further rotatable to other positions with further different surface angles. As illustrated in FIG. 14, the surface angle of the lowermost surface of the head 102 is changed at least in the front 124 to rear 126 direction. However, it is understood that the surface angle of the lowermost surface may additionally or alternately be changed in the heel 120 to toe 122 direction. Further, in at least one position of the sole member 180, part or all of the outer surface 133 may be flush or substantially flush with the adjacent portions of the body 108. For example, in the embodiment of FIG. 10, the outer surface 133 of the sole member 180 is substantially flush with the adjacent portions of the body 108 in the position shown in FIG. 13. It is understood that the moveable sole member 180 may also be removable from the body 108, and in the embodiment of FIGS. 11-14, the sole member 180 is removable by removing the post 136 from the aperture 137.

The head 102 may include a compression channel 140 as similarly described above and shown in FIGS. 2-5, and may include a spacing portion 154 spacing the channel 140 rearwardly from the edge(s) of the face 112. The head 102 may further include a plug 160 in the form of an insert that is separate from the sole member 180 and may be removably or permanently connected to the head 102 to at least partially fill at least a portion of the channel 140. The head 102 in the embodiment of FIGS. 11-14 includes a channel 140 and a plug 160 that is removably connected to the head 102 and completely fills a portion of the channel 140 adjacent the keel 156 and along the centerline of the head 102. In this embodiment, the outer surface 161 of the plug 160 is flush or substantially flush with the adjacent surfaces of the body 108, including the spacing portion 154 and adjacent surfaces of the keel 156, to form a substantially smooth keel 156 extending rearwardly from the spacing portion 154. The plug 160 in this embodiment includes a post 136 that is received in an aperture 137 in the channel 140 to connect the plug 160 to the head 102. The post 136 may have an enlarged head 138 and may be made of a resilient material in one embodiment, as described above. In alternate embodiments, the head 102 may not include any plug 160, and the head 102 may also have no channel 140.

Still other embodiments of removable and/or moveable sole members 130, 180 can be incorporated into a head 102 of the present invention. Further, it is understood that one or more different features of any of the heads 102 and the sole members 130, 180 described above with respect to FIGS. 1-15 can be combined in any combination in other embodiments.

Heads 102 incorporating the sole members 130, 180 disclosed herein may be used as a ball striking device or a part thereof. For example, a golf club 100 as shown in FIG. 1A may be manufactured by attaching a shaft or handle 104 to a head that is provided, such as the heads 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. In other embodiments, different types of ball striking devices can be manufactured according to the principles described herein. Manufacturing the heads 102 shown and described herein may include attachment of a sole member to the body 108, as described above. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefor as described herein provide many benefits and advantages over existing products. As one example, the sole members 130, 180 described herein can provide options for customizing properties of the head 102, such as the lie angle of the head 102 or other properties of interaction with the playing surface. Other properties can be achieved and/or altered by removal/interchanging or movement of the sole member 130, 180 as described herein. As another example, the use of the channel 140 and optionally the plug 160 within the channel 140 provide greater impact efficiency and greater energy and velocity transfer to the ball 106 during impact. As yet another example, the substantially smooth keel 156 and the outer surface 133 of the sole member 130, 180 can decrease drag and other forces on the sole 118 during contact with the playing surface, which can increase distance and accuracy. As an additional example, the features described herein may result in improved feel of the golf club 100 for the golfer, when striking the ball 106. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a striking surface configured for striking a ball, the face being defined by a plurality of peripheral edges including a bottom edge adjacent a sole;

a club head body connected to the face and extending rearwardly from the peripheral edges of the face, the club head body having a sole configured to face a playing surface and a crown opposite the sole, the club head body further having a receiver located on the sole; wherein the club head body and the face form an inner cavity; and a removable sole member received by the receiver, wherein the removable sole member has an outer surface forming a portion of the sole, wherein the removable sole member has a front surface spaced rearward from the bottom edge of the face and a rear surface, wherein the removable sole member has a first tab and a second tab, wherein the first tab is located near a front side of the removable sole member and extends into a first slot located near a front of the club head body and wherein the second tab extends from the rear surface of the removable sole member and extends into a second slot located near a rear of the club head body.

2. The golf club head of claim 1, wherein the removable sole member is removably received by the receiver and removably connected to the sole of the club head body.

3. The golf club head of claim 1, wherein the removable sole member comprises a third tab extending from a second rear surface of the removable sole member and extending into a third slot located near a rear of the club head body.

4. The golf club head of claim 1, wherein the receiver is recessed from a plurality of adjacent surfaces on the sole.

5. The golf club head of claim 1, wherein the removable sole member has a first leg extending in a rearward direction from a rear end of a body member of the removable sole member.

6. The golf club head of claim 1, wherein the removable sole member has an outer surface that is raised with respect to a surface of the sole immediately adjacent the receiver.

7. The golf club head of claim 1, wherein the first tab has a ramped surface.

8. The golf club head of claim 1, wherein an external surface of the removable sole member is substantially flush with a front portion of the sole, wherein the front portion of the sole is between the bottom edge of the face and the front surface of the removable sole member.

9. The golf club head of claim 1, wherein the club head body further has an elongated channel extending continuously across at least a portion of the sole, the elongated channel being defined by edges located on the club head body and comprising side walls extending inwardly from the edges to a recessed trough, such that the elongated channel is recessed inwardly from the sole.

10. A golf club head comprising:

a face having a striking surface configured for striking a ball, the face being defined by a plurality of peripheral edges;

a club head body connected to the face and extending rearwardly from the peripheral edges of the face, the club head body having a sole configured to face a playing surface and a crown opposite the sole, the club head body further having a receiver located on the sole; wherein the club head body and the face form an inner cavity;

a removable sole member received by the receiver, and removably connected to the sole of the club head body, wherein the receiver is recessed from a plurality of adjacent surfaces on the sole, wherein the removable sole member has an outer surface forming a lowermost portion of the sole, wherein the removable sole member has a body member and a first leg extending towards a toe of the golf club head and a second leg extending towards a heel of the golf club head, wherein the first leg and the second leg are separate and extend away from each other, and wherein the receiver has a complementary shape with the removable sole member such that the receiver has a base surface with a first protruding surface extending from a rear of the base surface towards the toe of the golf club head and a second protruding surface extending from the rear of the base surface towards the heel of the golf club head, wherein the first protruding surface and the second protruding surface are separate from each other; and wherein the first leg of the removable sole member is received in the first protruding surface of the receiver and the second leg of the removable sole member is received in the second protruding surface of the receiver.

11. The golf club head of claim 10, wherein the removable sole member is formed from a carbon fiber composite material.

12. The golf club head of claim 10, wherein an external surface of the removable sole member is substantially flush with a front portion of the sole, wherein the front portion of the sole is between a bottom edge of the face and a front surface of the removable sole member.

13. The golf club head of claim 10, wherein the removable sole member is removably connected to the receiver using a plurality of mechanical fasteners.

14. The golf club head of claim 10, wherein the first leg extends toward a rear of the golf club head and the second leg extends toward the rear of the golf club head.

15. A golf club head comprising:

a face having a striking surface configured for striking a ball, the face being defined by a plurality of peripheral edges;

a club head body connected to the face and extending rearwardly from the peripheral edges of the face, the club head body having a sole configured to face a playing surface and a crown opposite the sole, the club head body further having a receiver located on the sole, wherein the club head body and the face form an inner cavity;

a removable sole member received by the receiver and removably connected to the sole of the club head body, the removable sole member forming at least a portion of a lowermost surface of the golf club head, wherein the removable sole member has a rear end and two legs extending rearwardly from the rear end, and wherein the legs are separate and extend away from each other, wherein the removable sole member is a single piece;

wherein the receiver has a complementary shape with the removable sole member such that the receiver has a base surface with two protruding surfaces extend from a rear of the base surface towards the rear end of the golf club head, wherein the two protruding surfaces are separate from each other; and wherein each of the two legs of the removable sole member are received in each of the protruding surfaces of the receiver.

16. The golf club head of claim 15, wherein the removable sole member has an outer surface that is substantially flush with a front portion of the sole.

17. The golf club head of claim 15, wherein the receiver has a plurality of peripheral edges and is recessed from adjacent surfaces on the sole.

18. The golf club head of claim 15, wherein the club head body further has an elongated channel extending continuously across at least a portion of the sole, the elongated channel being defined by edges located on the club head body and comprising side walls extending inwardly from the edges to a recessed trough, such that the elongated channel is recessed inwardly from the sole.

19. The golf club head of claim 15, wherein the removable sole member is removably connected to the receiver using a plurality of mechanical fasteners.

* * * * *